US011495083B2

(12) United States Patent
Goodwin, Jr.

(10) Patent No.: US 11,495,083 B2
(45) Date of Patent: Nov. 8, 2022

(54) ENTERTAINMENT MACHINE

(71) Applicant: Matthew T. Goodwin, Jr., Boston, MA (US)

(72) Inventor: Matthew T. Goodwin, Jr., Boston, MA (US)

( * ) Notice: Subject to any disclaimer, the term of this patent is extended or adjusted under 35 U.S.C. 154(b) by 0 days.

(21) Appl. No.: 17/205,012

(22) Filed: Mar. 18, 2021

(65) Prior Publication Data

US 2022/0301385 A1 Sep. 22, 2022

(51) Int. Cl.
*G07F 17/32* (2006.01)

(52) U.S. Cl.
CPC ..... *G07F 17/3211* (2013.01); *G07F 17/3223* (2013.01)

(58) Field of Classification Search
CPC ..... G07F 17/3211; G07F 17/3223
See application file for complete search history.

(56) References Cited

U.S. PATENT DOCUMENTS

| | | | | |
|---|---|---|---|---|
| 5,810,663 | A | 9/1998 | Bochichio | |
| 5,865,437 | A | 2/1999 | Moore, Jr. | |
| 8,029,356 | B2 | 10/2011 | Klein | |
| 2001/0048197 | A1 | 12/2001 | Lo | |
| 2003/0050106 | A1 | 3/2003 | Lyfoung | |
| 2004/0204226 | A1* | 10/2004 | Foster | G07F 17/3262 463/20 |
| 2005/0116418 | A1 | 6/2005 | Hoyt | |
| 2007/0191087 | A1* | 8/2007 | Thomas | G07F 17/34 463/20 |
| 2008/0058057 | A1* | 3/2008 | Lau | G07F 17/329 463/17 |
| 2010/0096808 | A1 | 4/2010 | Johnson | |
| 2011/0163501 | A1 | 7/2011 | Nguyen | |
| 2013/0095902 | A1 | 4/2013 | Smith | |
| 2015/0221161 | A1* | 8/2015 | Reid | G07F 17/3225 463/17 |
| 2015/0302482 | A1* | 10/2015 | Vagner | G06Q 30/0269 705/14.66 |

FOREIGN PATENT DOCUMENTS

| | | |
|---|---|---|
| WO | 2015004637 | 1/2015 |
| WO | 2015024024 | 2/2015 |

* cited by examiner

*Primary Examiner* — Werner G Garner
(74) *Attorney, Agent, or Firm* — Lambert Shorten & Connaughton; David J. Connaughton, Jr.; Justin P. Tinger

(57) ABSTRACT

An entertainment machine is provided. The machine provides a unique display and input/output system, and structure. The entertainment machine provides optional and unique features including betting structures. The entertainment machine may include networked embodiments to allow for multi-player engagement. Further, computerized players may be programmed to mimic real players including to present biases and other predictabilities to mimic actual human tendencies.

20 Claims, 4 Drawing Sheets

ENTERTAINMENT MACHINE

BACKGROUND OF THE INVENTION

Field of the Invention

The present invention relates generally to a gaming system. More particularly the present invention relates to a game and entertainment machine device providing strategic and advantageous modes of game play.

Description of Related Art

Casino-based table games, and their computerized counterparts, are staples at casinos, other gambling establishments, and online. While there are a number of common games, they can become stale and repetitive over time, leading players to seek out new gaming opportunities. The gaming industry is constantly trying to retain the attention of its current customers, and to grab the attention of potential customers. Accordingly, new and exciting gaming opportunities are critical for maintenance and growth of the gaming industry.

Casinos and other gaming operators are faced with a number of shortcomings of existing table games. These include feelings by players that they are being cheated by the house, adversarial positioning between players and the casino caused by game play set ups, speed and capacity limitations on games, and policing cheating/collusion that occurs within their games.

Therefore, what is needed is an entertainment system which may provide a fair, non-contentious relationship with game operator and players, increase game play speed and capacity, and limit collusion and other rule breaking.

SUMMARY OF THE INVENTION

The subject matter of this application may involve, in some cases, interrelated products, alternative solutions to a particular problem, and/or a plurality of different uses of a single system or article.

In one aspect, an entertainment machine is provided. The entertainment machine as a data processor, display in communication with the processor, and user interface in communication with the data processor. Further, the machine includes a computer memory which stores program instructions executable by the data processor to carry out operation of the entertainment machine. In one embodiment of operation, the entertainment machine may be programmed to receive an input from a player regarding selection of one of a plurality of slots through the user interface, along with a bid amount from that player. Similar slot selection and bid amount are received from a plurality of other players either through the user interface, through a networked connection with the data processor, or other input. The processor may then calculate a total number of selections of each of the plurality of slots and determine the one of the plurality of slots having the fewest non-zero selections. The processor may then distribute a proportional payout of the total bid amounts to any of the player and the plurality of players who selected the determined slot having the fewest non-zero selections.

DETAILED DESCRIPTION

Figure 1:
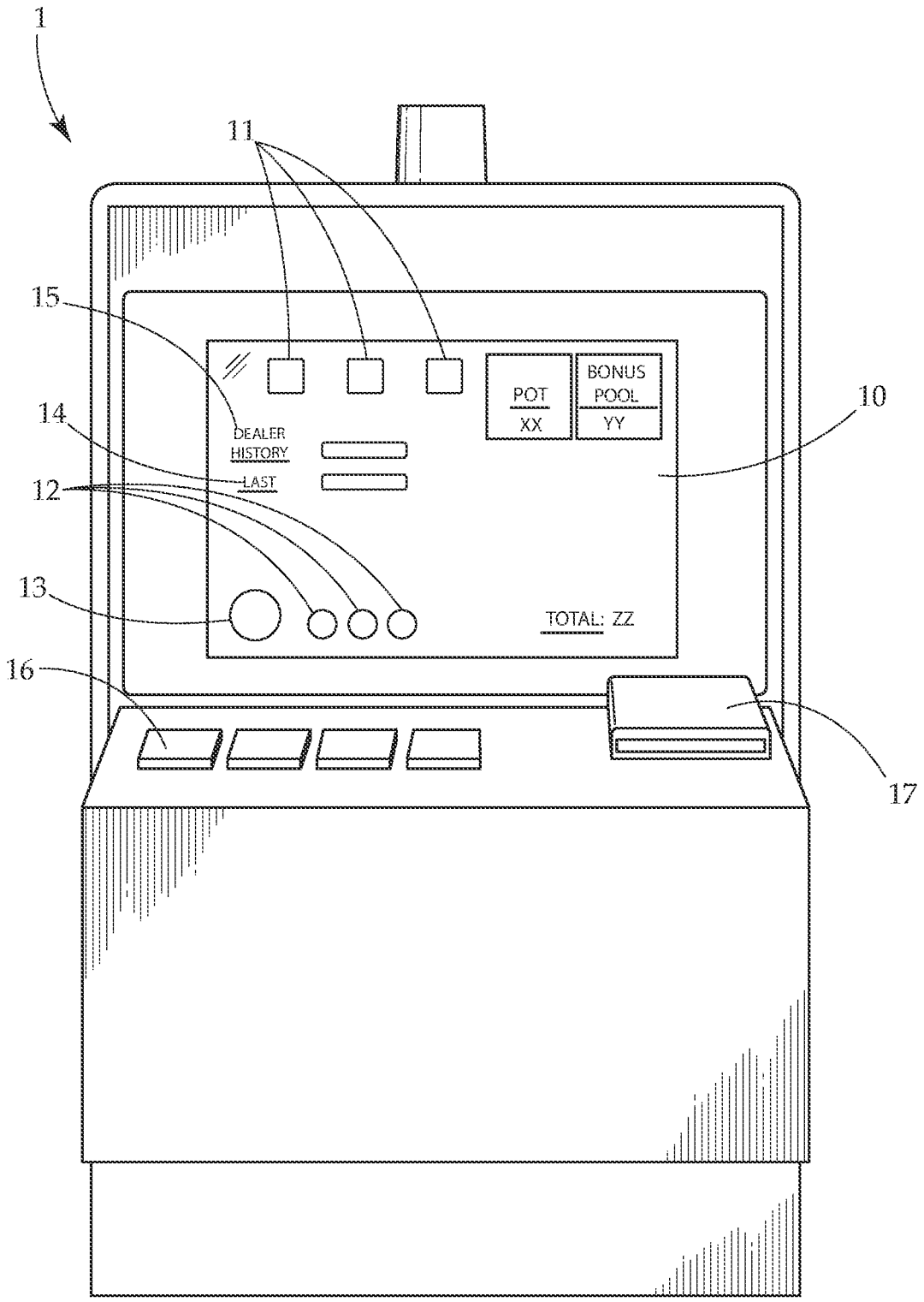
FIG. 1 provides a view of an embodiment of an entertainment machine of the present disclosure.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, an entertainment system, also referred to as an entertainment machine providing a unique operation, payout, programming, and structure is provided herein. The entertainment system provides an exciting, entertaining, and engaging new system. The entertainment machine provides optional, unique game play features. These features may include a unique game play and set of cards or markers (physical or virtual) which focuses on strategic betting and risk taking.

The present disclosure relates to an entirely new table game to the industry, which gets away from the usual paradigm of many new table games (which are just a slight tweak to an already established game). This game is unlike any other game in the industry, and will provide more nuance and variety to an industry that is constantly trying to retain the attention of its current consumers, as well as grab the attention of potential consumers. This game simultaneously reduces the risk and exposure that casinos usually face in table games (advantage players exploiting flaws in the house edge and taking the casino for large sums in a given night, or players just leaving the game after a big win before the odds can catch back up with them) to virtually zero, while also correcting the power imbalance and conflict of interest that many players feel they are subjected to when they play in a casino. The number one concern of players when they play table games in a casino is that they are being cheated by the house, or that the odds aren't really fair. The outcomes of this game are solely a consequence of the collective decisions of the players. The winners and losers of this game are essentially determined by a free market; and the casino takes on the role of market regulator—it becomes a protector and facilitator of fair play, rather than an adversary to be fought against.

This will greatly improve the relationship that casinos have with their patrons, as well as pave the way for the new acquisition of would-be patrons who do not currently play in casinos for fear of the aforementioned adversarial relationship. This game also has built-in incentive structures which deter collusion, something that is unheard of in any other table game. One of the biggest costs that casinos face is the cost of policing cheating/collusion that occurs within their table games. This game's payout structure, insurance system, and the way in which players win a hand all create a dynamic where the number of colluders and the amount of capital needed to capitalize on collusion and receive a (usually less-than-commensurate) payoff is not worth it in the long run, or even short run, especially as the number of players in a game increases. This dynamic greatly reduces both the risk of cheating and the burden that casinos carry of taking measures to ensure fair play for everyone The present disclosure also bolsters the trust that players would have that the game they are playing is not being unfairly manipulated against them, which is one of the most important factors in this industry. This game offers a speed of gameplay that rivals or surpasses any existing games.

The number of possible hands played per hour is impressively large (upwards of 200 based on my more conservative estimates), and is non-dilutive with respect to how many players are currently playing—meaning that the number of hands played per hour does not decrease at all when more players join.

There is also virtually no upper limit on the number of players who can participate in a game at once—something that is almost unheard of in any other table games currently offered in the industry. Not only does this mean more potential revenue for casinos, but it also provides players the exhilaration of playing against large communities of players at the same time, to a degree and scale they would never be able to experience with any other table game.

This, combined with the speed of hands played per hour, would produce a refreshingly unique and exciting experience for casino patrons who are always looking for new ways to be excited and entertained.

Initially, the system will begin by gathering a plurality of players, either directly at a gaming table, or virtually by computerized networked communication. In most embodiments, it is preferable to have five or more players, though as few as three may play without straying from the scope of this invention. Players may come and go to the game between different rounds without disrupting game play. At the beginning of the game and/or as a new player enters the game, the player either purchases chips or brings existing chips (physical or digital), which correspond to a monetary value and which are used to wager each round. Chip number and amount may vary depending on player preference, but each round will require a minimum bid. In addition to the chips, each player may be given one "Insurance Chip" (again digital or physical) to be used in game play as discussed below. Finally, each player will be issued a predetermined amount of at least three cards, markers, or buttons/indicators (herein generally referred to as "indicators"), and in some embodiments more. These indicators operate to inform the dealer or system computer (operating as a "dealer") of what option of a certain number of options is selected by the player, as will be explained in detail below. Each card or marker will correspond to one of a plurality of selection option "slots." The game involves a dealer (either a person, or computerized) who facilitates the games.

Gameplay operation on the computerized gaming machine, or table game, will involve a series of hands or rounds. In each round, every player selects one of their plurality of indicators corresponding to one of an equal number of slots. Typically there are three slot options, but additional slots may be provided depending on embodiment. This selection of a particular slot is done privately by each player, and at this stage the only party who knows player selection is the dealer (or computerized system operating as dealer). In computerized embodiments, slot selection may be provided to the system by a user by indicating their selection of a slot via a computerized user interface via, for example, a gesture or other input.

In addition to slot selection, a wager is made by each user on their slot selection. The wager of each user is put into a pot of that hand. Each game will have a minimum amount of chips that must be bid by every player for each slot selection. Upon completion of selection and bidding, each player's slot selection is presented.

A goal of the system is for a player to select the "minority position." The minority position is the slot which has the absolute least amount of selections by players, but it must be a non-zero amount. It is also not possible for two slots to have the minority position of a round, even if they are tied as least-selected slots. In a tie situation, there is no minority position in a round.

In a round having no minority position, the chips in the pot are set aside on reserve into a bonus pot. The bonus pot will be allocated in periodic dealer rounds in which players seek to select a same slot as chosen by the dealer as discussed in detail below. This requires strategy and careful consideration of player tendencies because players do not want to change their selection to a highly-selected position, but also likely will want to change their selection so as to not continue to have dealer or regular rounds without payout.

Again, winners of each regular rounds are the players who selected the slot corresponding to the minority position. Each winner will receive a payout from that round. Payout for each winner will be a proportion of the total pot equal to the proportion of their bid out of the total chips bid by players in the minority position. For example, if there are two winners, and the first bid one chip, while the other bid two chips, the first winner will get ⅓ of the total chips, the second winner will get ⅔ of the total chips. In one embodiment, the resulting chip payout will be rounded to the nearest whole number, but in other embodiments, fractional chips, or smaller value chips may be provided to provide a proper accounting. In one embodiment, total chip payout will be rounded down to the nearest whole chip number with the balance paid to the "house."

In computerized embodiments, the computerized system is operable to calculate and apply proper payouts to each player. These payouts may be redeemed for cash through a payout system, or redeemable for cash value via a voucher or by application of a payment to a card such as a stored value card or credit card. The system may be implemented on a machine having a card reader, printer, or other input/output system to provide the payout in a cash or cash-redeemable medium.

Players may leave and enter the game between each round as they like. In one embodiment, players may only enter a game after a round having a minority position has been completed.

Players may opt to purchase insurance using their "insurance chip" or otherwise by indicating their selection of an insurance via a computerized user interface via, for example, a gesture or other input. Insurance is selected by a player to protect against there being no minority position in a particular round. Insurance purchase is separate from the regular bid and slot selection. After the bid is submitted and insurance is requested by a player, the player submits the amount of chips they want to buy insurance with.

In the event that there is no minority position, in one embodiment, players who have purchased insurance receive a proportional payout of their insurance bid. If there is a minority position, insurance bid chips are put into a "bonus pool." If there are chips in the bonus pool, these are added to the proportional payout when an insurance payout occurs with the bonus pool being distributed either evenly or proportionally to each player who purchased insurance, depending on embodiment. This bonus pool payout is in addition to the regular insurance payout owed to each player who has purchased insurance in around where there is no minority position.

In one embodiment, if there are chips in a bonus pool during a round which has no Minority position, but in which no player has purchased insurance, then the entire bonus pool may be split evenly among the players who bid the most that round. In a further embodiment, rounding the chips to a whole number, any non-paid out chips may remain in the bonus pool in one embodiment, or may be paid to the house in another embodiment.

In another embodiment, a fractional pot odds system of insurance payout may be used. First and foremost, any player can buy insurance during any regular hand—betting on the possibility of that hand not having a Minority Position at all. The only limitation on the amount of insurance that can be purchased by a player is it must be at least as much as whatever the posted minimum bid is for each hand within that particular game. Besides this, a player can place whatever amount of money they want on an insurance bet.

Any insurance payouts to be made are sourced from the existing regular pot of a hand.

This is where main nuance of this new system of insurance comes in—the payout structure. When an insurance payout is to be made to a player, that player's insurance payout is based on a combination of both the ratio of total money in the regular pot to the total money purchasing insurance, and the fraction of individual insurance purchased by that player out of total money purchasing insurance. By combination, I mean that you would multiply this ratio and fraction together—and the resulting product would be the payout ratio that the player would receive on their insurance bet.

For example: Assume that for a given hand, there is $8 within the regular pot, and $4 of total insurance has been purchased across all players. That means the ratio of money in the pot to money purchasing insurance here is 2:1

Now say that all $4 being purchased in insurance is coming from only one player. This means that player's fraction of individual insurance out of total insurance purchased is 4/4 (i.e. 1).

If the insurance bet pays off on that hand (meaning that there was no Minority Position during that hand), then that player's insurance payout would be calculated as follows:

(ratio of pot-to-insurance)×(fraction of individual insurance)×(individual insurance purchased)

so, (2:1)×(1)×($4)=$8

In this scenario, the player would receive an $8 payout on their insurance bid, in addition to getting back their initial $4 insurance wager (this example does not account for the 10% cut of the pot that the casino would receive).

Notice that the payout received by this player constituted the entirety of the regular pot of that hand. So by purchasing insurance, this player has won the entire pot, instead of letting the money be put into the Bonus Pool (as would've happened if no one had purchased insurance).

The nuance of this new system of insurance is that as more players purchase insurance, the total amount of money that is paid out from the pot to insurance bettors decreases.

For Example: Building off of the last example, assume again that there is $8 in the pot and $4 in total insurance—so, again we have a 2:1 pot-to-insurance ratio.

But now, assume that the $4 of total insurance is coming from two players instead of one, and both of them have purchased $2 of insurance. This means that they each have an individual insurance fraction of ¾ (or ½).

If the insurance bet pays off, these players' payouts would be calculated as such:

Player 1=>(2:1)×(½)×($2)=$2

Player 2=>(2:1)×(½)×($2)=$2

In this scenario, each player receives an insurance payout of $2 (in addition to getting their initial insurance bet back), which means that a total of $4 of the regular pot was paid out in insurance—only half of the total $8 in the pot. Even though the amount of money in the pot and the amount of money purchased in total insurance did not change, the increase in the number of players purchasing insurance led to less of the pot being paid out, and each player having a lower payout ratio than the pot-to-insurance ratio.

With more insurance bettors, each of them must try to bid more in insurance than the others if they want to secure a payout ratio that will be closer to the pot-to-insurance ratio, and have a higher insurance payout. Those who bid less in insurance will have a severe cut in the payout of their insurance bid. Also, the closer the highest insurance bettor gets to an individual insurance fraction of 1, the more that is paid out in total insurance from the pot.

You can see both of these dynamics with this example (building off the last): Assume again there is $8 in the pot and $4 in total insurance, giving us a pot-to-insurance ratio of 2:1 again Assume there are still two players betting insurance, but Player 1 is betting $3 in insurance and Player 2 is betting $1 in insurance. This means that Player 1 now has an individual insurance fraction of ¾ and Player 2 has a fraction of ¼.

Now their insurance payouts would be calculated as such:

Player 1=>(2:1)×(¾)×($3)=$4.50

Player 2=>(2:1)×(¼)×($1)=$0.50

In this example we can see that now with the players having unequal fractions of the total insurance, their payout ratios differ greatly. Whereas before they both enjoyed a 1:1 payout on their insurance bids, now Player 1 enjoys a bump to a 3:2 payout on their insurance while Player 2 has downgraded to getting only a 1:2 payout from theirs. Also notice how the total money paid out in insurance has increased. Before, there was $4 in total insurance payouts from the pot, leaving $4 to be put into the Bonus Pool. Now, there is $5 in total insurance payouts from the pot, leaving $3 to be put into the Bonus Pool. As explained before, as the highest insurance bettor gets closer to an individual insurance fraction of 1 (here, Player 1 went from a fraction of ½ to ¾), the more of the pot that is paid out in insurance.

General rules for insurance payouts:

All else being equal, as the number of insurance bettors increases, the amount of total insurance payouts from the pot decreases.

All else being equal, the more commensurate the insurance bids from each insurance bettor, the less total insurance that is paid out from the pot.

The dynamics of this payout structure disincentives over-insuring a pot; and it also disincentives colluders who may potentially force hands into scenarios where having no Minority Position is more likely. In order to capitalize on this collusion, they would need to risk more and more money in insurance bets and would realize less and less gains as more people catch on and start to purchase insurance as well. This disincentive is further magnified when taking into account what happens when insurance is not paid out.

What Happens When Insurance is Not Paid Out?

If insurance bids do not pay off on a certain hand (i.e. there actually was a Minority Position), then all of the insurance bids are put into the Bonus Pool.

If a player's slot selection ends up winning the Minority Position and they've also purchased insurance, they would lose their insurance bid to the Bonus Pool but could still be eligible for a regular pot payout—depending on how much they wagered in insurance.

For a player who has made an insurance bid but is also in the Minority Position, their insurance bid would be levied against the amount of money they put up in the regular pot when determining their payout. Specifically, the value of their insurance bid would be subtracted from value of their regular bid (and consequently the total money being bid in the Minority Position) when calculating their proportionate payout of the pot, as well as the proportionate payouts of all other players who are also in the Minority Position.

Example: Assume that there is $12 in the pot, and Player 1 and Player 2 have both won the Minority Position with their slot selections. Say Player 1 and Player 2 each have bid $2 in the regular pot, but Player 1 has also purchased $1 in insurance. If neither players had purchased insurance, each of their payouts would have been calculated as follows:

(individual bid/total bids in Minority Position)×
(money in the pot)

so, Player 1=>Player 2=>($2/$4)×($12)=$6

Thus, each player would have received $6, or half of the pot—which makes sense, as there are two of them and they both bid the same amount.

However, in this scenario you would need to factor in the insurance bid that Player 1 made. This means that you would subtract that value from his regular individual bid and the total bids in the Minority Position in this calculation (which should be the general equation to determine player payouts):

[(individual bid−individual insurance)/(total bids in
Minority Position−insurance bids in Minority
Position)]×(money in the pot)

Player 1=>[($2−$1)/($4−$1)]×($12)=$4
Player 2=>[($2−$0)/($4−$1)]×($12)=$8

As such, even though both players bid the same amount in the regular pot, Player 1's decision to purchase insurance cost him in his regular bid when it didn't pay off (in addition to losing the insurance bid to the Bonus Pool). His insurance purchase effectively reduced his proportionate payout of the pot of $12 from ½ to ⅓ (and subsequently increased Player 2's proportionate payout from ½ to ⅔).

In the event that a player is in the Minority Position of a hand, but has purchased an amount of insurance which equals or exceeds their regular bid, that player's claim to a proportionate payout of the pot would effectively be nullified. So in the previous example, if Player 1 had bid $2 in insurance instead of $1, then the calculated payout of each player would look like this:

Player 1=>[($2−$2)/($4−$2)]×($12)=$0
Player 2=>[($2−$0)/($4−$2)]×($12)=$12

An important note to make here is that even if Player 1 had bid $3 in insurance, you would still only take away $2 within the numerator of their proportion and $2 within the denominator of both players' proportions. When levying the insurance bid of a player in the Minority Position against their regular bid, you only levy an amount of their insurance bid up to a maximum amount of their regular pot bid. Any amount of their individual insurance bid that exceeds their regular bid would not matter when levying against it.

In the prior example, if Player 1 had bid $3 in insurance instead of $2, then when determining the payouts of both players, only $2 of the $3 Player 1 purchased in insurance would be levied against his numerator and the denominator of both players; and the equations would look the exact same.

If all of the players that have won the Minority Position in a given hand have also purchased insurance—and all of them have individual insurance bids that equal or exceed their regular bids—then all of their payouts would be nullified, and all of the money in the pot would be put into the Bonus Pool.

In some embodiments, the game play may involve a "dealer round" when the dealer randomly selects one of the slots without showing the players. The remaining players have the chance to guess the dealer's selected slot by choosing one themselves by playing the indicator or providing an input into a user interface selecting a slot. Some embodiments of the dealer's round may include a bid by each player. The dealer round may occur after a predetermined number of normal game play rounds with no payout and/or to dispose of value in the bonus pot, such as five rounds. In other embodiments, dealer rounds may be played at predetermined time intervals such as one dealer round every ten minutes, and the like or may be played randomly as determined by a timer or computerized randomizing programming. Any winning player will split the bids and/or bonus pot proportionally or evenly, depending on embodiment. In some embodiments, the dealer rounds may include a bidding process with the payout being the bonus pool plus any bidding in the dealer round, while in other embodiments, the dealer round may involve only selecting a slot with a goal to match the dealer's selected slot, with the payout being limited to the bonus pool.

The dealer round is the mechanism for paying out monies in the bonus pool. The dealer round begins with a dealer selecting a particular slot, and the players participating in the round seeking to correctly guess the dealer's selection by selecting a slot that they believe that the dealer selected. In one embodiment, the bonus pool is paid out to those players who have matched the dealer's selection. In one embodiment of game play, if no players match the selection, the round can be repeated until at least one player matches the dealer's slot selection. Alternatively, in a dealer round where no players match the dealer, the bonus pool "pot" may remain in the bonus pool to be rolled forward to the upcoming dealer round.

In another embodiment, an elimination style series of dealer rounds may occur such that the bonus pool is paid out once ½ or less of the original dealer round players have been eliminated. For example, in a dealer round with 6 players, if 4 match the dealer, a subsequent round will be played with these four players, and if one or two players match the dealer this time, then the bonus pool is paid out to them. If three match the dealer, all three receive the bonus pool because three is half of the original six dealer round players.

In certain embodiments, only players who have been playing for a predetermined number of rounds may participate in the dealer round. This prevents potential players from lurking until a dealer round is about to begin and jumping in only then when other players have filled the bonus pool. For example, in an embodiment having a dealer round every five rounds of regular game play, only those players having participated in the full five rounds may play in the dealer round. These specifics may vary depending on round and game play. In another embodiment, for example, in an embodiment having a dealer round every three rounds of regular game play, only those players having participated in the full three rounds may play in the dealer round.

In one embodiment having a computerized dealer including, but not limited to a computerized game system or machine, the dealer may be programmed to overweight or underweight one or more slots to select during the dealer round. This overweighting or underweighting, rather than a purely random slot selection during the dealer round, allows for players to identify a "tendency" of the computerized dealer. This solves the problem that a truly randomized dealer selection makes guessing the dealer's slot very difficult. However, in a system having the dealer's slot selection be biased to one particular slot, players who are engaged, especially over long playing times, may be able to make a more educated guess of the dealer's proclivities. In a further embodiment, dealer slot selection history may be displayed for the past rounds or a certain number of past rounds of dealer round.

An algorithm may be used to check and re-check the dealer bias weighting over time to ensure that it is properly weighted as desired by the system administrator. It is a known problem in the computer arts that such programming, either a pure randomizer or a slight weighing may "drift" over time away from the desired weighing. Therefore, this algorithm operates as a check or "self-diagnostic" to ensure that the weighting does not stray from the desired weighing. Similarly, in randomized dealer slot selection embodiments, the algorithm is operable to ensure that the system does not stray from the ramdomization and go towards a clear bias. The diagnostic may check dealer bias or lack thereof (depending on embodiment) periodically, such as hourly, every 12 hours, daily, every two days, weekly, monthly, or the like.

Of course, the programming will not cause the dealer to pick the same slot over and over, but will likely weight one more heavily over time. This is similar to natural human biases and can make the game more realistic. Such a system also operates to keep players engaged for longer to try to determine the dealer tendencies over time. This leads to better game play and greater revenue for the system administrator such as a casino.

The entertainment machine is formed generally by a machine body, which provides a housing and structure for the entertainment machine. On and in this body is an interface, which allows input into the machine and output to a player of the machine. The input includes a money or payment input (generally referred to herein as a payment input), which may be a card reader, cash input slot, electronic payment input, or the like. A betting input is also present as part of the interface. The betting input allows a user to select a wager quantity and/or type, such as a minimum bet. A display output is provided as part of the interface. This may be a computer display screen, or the like. The interface further has a payout output, which provides a way for a player to receive a payout. This may be through a printed ticket, electronic credit, cash output, and the like.

In a computerized embodiment, a computer may provide one or more computerized "players." Such a computerized player may randomly select one of the plurality of slots, as programmed by a ramdomizing function. Bid amount may also be randomized within a predetermined percentage range of the chip totals and/or based on programming to optimize the betting and strategy. In embodiments using a randomizer, a secondary check may be performed periodically by the computerized system to ensure a truly random pattern is followed and to ensure that the computer picks an approximately even number of each of the plurality of slots. This will solve the problem in the computing field of having so called random selections follow a pattern or be heavily skewed to one selection or another. The computerized system, via the processor, may then adjust selections to guide the selections back to the desired rate. This ensures fair and steady game play to computerized "players. Also, computerized players solve the problem of non-networked computer game play in the event that either a player wants to play but cannot gather enough other players, or wants to play but does not have networked access to reach other players online.

In another different embodiment, the computerized player may be programmed to select slots using a weighted randomizing function, such that slot selection is weighted towards one of the plurality of slots. This may mimic human behavior which necessarily shows tendencies and biases. Moreover, such weighted gameplay may allow for observant human users to identify biases by the computerized player and try to outsmart the system, to improve game play excitement and engagement. In embodiments using a weighted randomizer biasing selection towards one of the plurality of slots, a secondary check may be performed periodically by the computerized system to ensure a truly weighted pattern is followed and to ensure that the computer picks a particular slot at a predetermined greater rate than the other of the plurality of slots. This will solve the problem in the computing field of ensuring that the desired weighting is actually operating as desired. The computerized system, via the processor, may then adjust selections to guide the selections back to the desired rate. This ensures fair and steady game play to computerized "players.

In electronic versions of the present invention, a computer having a computerized data processor controls the game play of the machine. The randomizer may be a programmed module, such as an instruction set executable by a data processor, stored in a memory. The computer may be further configured to receive inputs from the interface, and provide output through at least a display screen and, optionally, through other outputs such as lights and/or speakers. In one embodiment, the display may be a touch screen, such that it also may receive inputs such as those noted above. Such electronic versions of the present invention may include a computerized entertainment machine, and may also be in the form of fully digital implementations such as a computerized implementation playable on a computer such as a tablet, smartphone, kiosk, desktop or laptop computer, as well as network based embodiments, internet embodiments, or application embodiments.

In further detail, an embodiment of entertainment machine contemplated herein may comprise a data processor. The processor may be in communication with a display, a player interface, as described above, and a memory device. The memory device may contain the randomizer module, as well as electronic representations of the cards or markers, game layout, and related graphics, for presentation by the display. The memory may further contain program instructions, in addition to the randomizer module's instructions. These instructions are executable by the data processor to conduct the steps of the game play, as will be detailed below.

One aspect of the invention may also include a non-transitory computer readable medium having instructions allowing and instructing the data processor to carry out the steps required during game play of the entertainment machine, as described herein. This non-transitory computer readable medium may be stored within the housing of the entertainment machine, or may be accessible through an electronic communication system such as a network and/or internet connection.

In certain machine based embodiments, a networked operation to allow multiple players on different machines to engage in the same session. This may provide an enhanced social aspect to the entertainment machine. In such embodiments, a computerized network connection connects the memory and processor of the entertainment machine to the internet, local area network, and/or other entertainment machines directly. The networked connection may provide an input to a particular entertainment machine, and this input may cause the processor to display a hand and optionally bets of a networked user playing on that different entertainment machine on the display of the entertainment machine.

Turning now to FIG. 1, a view of an entertainment machine of the present invention is shown. The entertainment machine 1 has a body which contains the internal components (not shown). The machine has interface elements such as buttons 16 and in some cases touch screen 10. Buttons 16 and/or touch screen 10 are operable to input the slot selection and bid amount for each game round. The machine includes a payment input/output 17 in this embodiment shown as a card reader which can deduct and load value to a payment card. Other input/output structures may be used such as a bar/QR code scanner and ticket printer, cash scanner and dispenser, and the like. In other embodiments, the machine may simply log into a player's computerized account, stored on a server, which provides access to the player's payment options such as a stored value account, credit card, and the like.

Display 10, in this embodiment a touch screen, is in communication with the computerized internal components, as discussed above. The display provides a visual output and feedback as to the game play, including confirming a player's slot selection and bid amount, reporting game progress, and the like. As shown, the display shows the slot options 11, here shown as three slots although in different embodiments, different numbers may be used. The display 11 also provides indicators 12 which represent the user's slot selection for a particular round. The user may provide an input such as a touch input on one of the indicators 12 to pick a particular slot. An insurance chip indicator 13 is presented on the display. A selection, by touch or gesture input to the touch screen 11 or the like, activates the insurance process as discussed above. The display also displays the player's total chip value, amount of money in the pot, and amount of money in the bonus pool. Also, each player's insurance bid, if any, may be displayed. This display may also optionally display a certain number of the player's last slot selections at display area 14, as well as dealer history in the dealer rounds at display area 15. After one round has completed, the player may elect to play another round or not. It should be understood that all of the inputs and outputs are in communication with the computerized system as noted above. Namely, the microprocessor, which can receive inputs and provide outputs depending on operation, is programmed based on a memory to carry out the steps and various processes of the gaming system disclosed herein.

Figure 2:
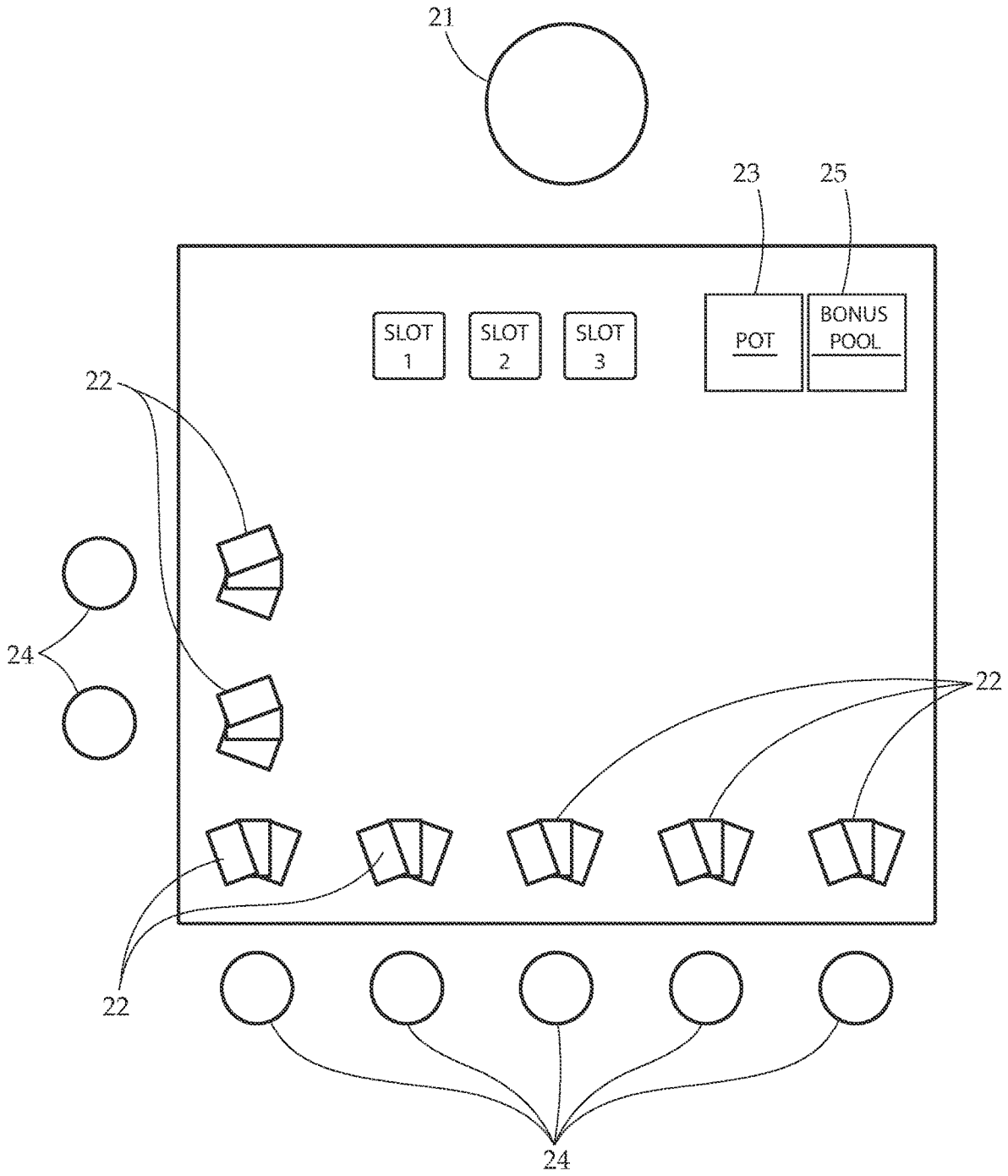
FIG. 2 provides a view of an embodiment of the entertainment system of the present disclosure being played in an in-person setting as a table game.

FIG. 2 shows an embodiment of the game system being carried on in person at a casino. A dealer 21 is at the head of the table, while players 24 are opposite the dealer and on one side. Each player has a hand of three cards (or other tokens/markers identifying a slot number) 22 or other indicators which may be used to secretly identify what slot the player selects. Also on the table are markers for each of the three slots, as well as areas marked on the table to store the pot 23 of bid chips, as well as the bonus pool 25 for dealer round games.

Figure 3:
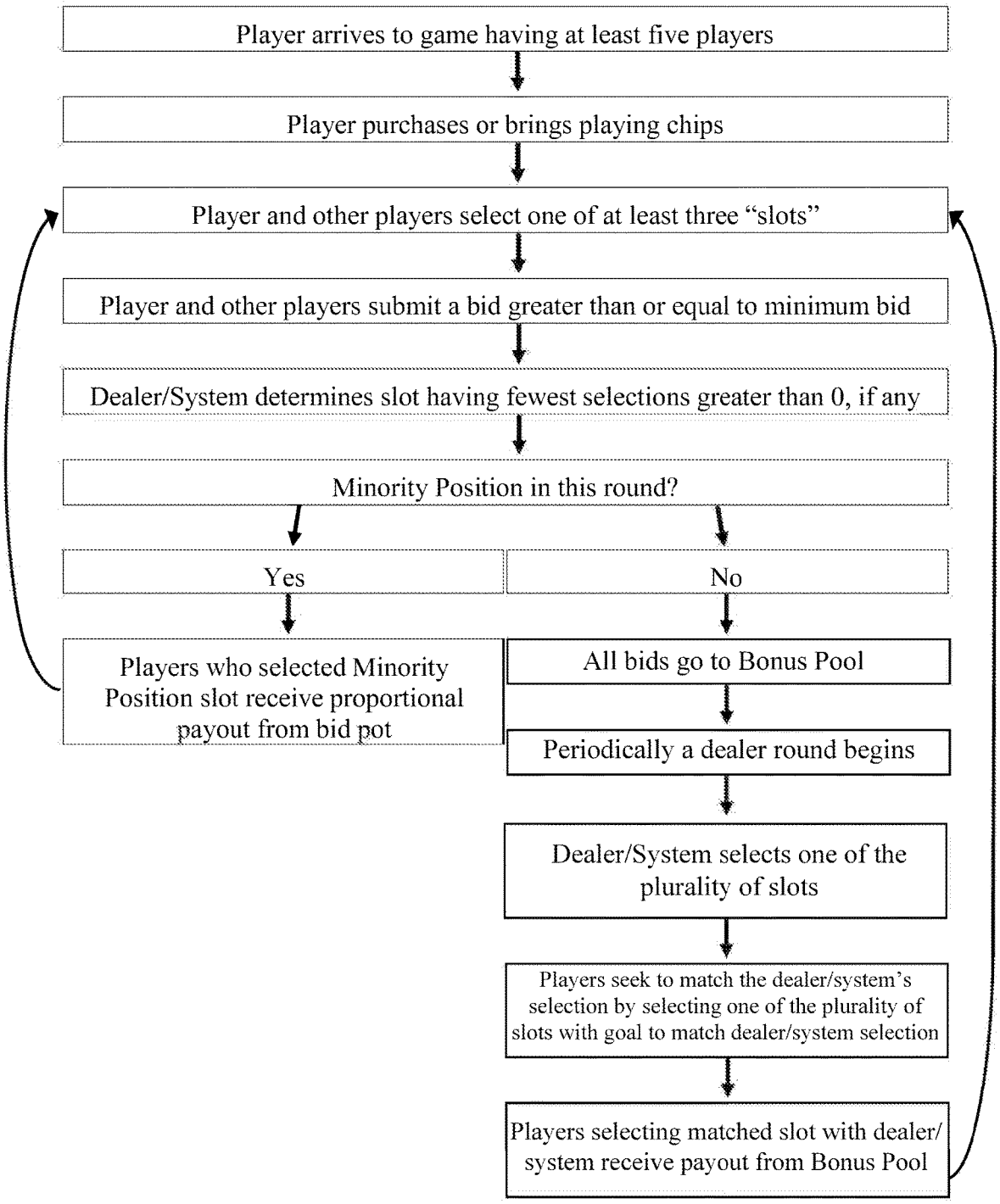
FIG. 3 provides a flow chart of an embodiment of operation of the present disclosure.

FIG. 3 shows a flow chart of an embodiment of the steps of the entertainment system progression. The operation begins with a player arriving to a game which has at least five players, or which reaches five players when the player arrives. The player will bring chips or may purchase chips when arriving to the game, these chips represent a cash value and are used for bidding in the game.

Figure 4:
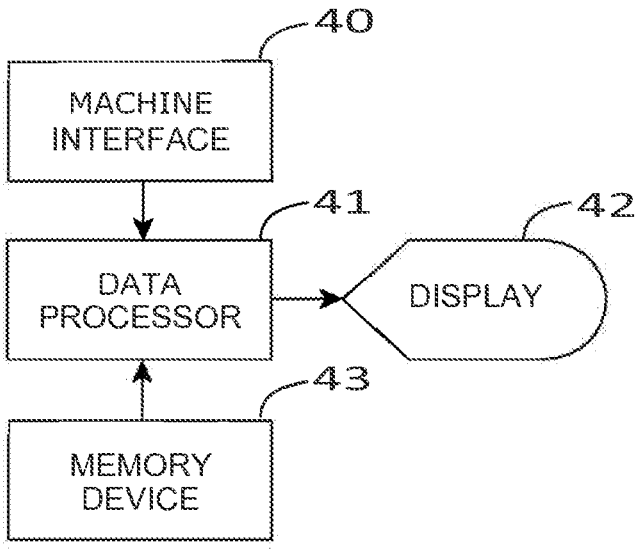
FIG. 4 provides a simplified schematic view of an embodiment of the computerized communication of the entertainment machine.

FIG. 4 provides a simplified schematic view of an embodiment of the computerized communication of the entertainment machine. The entertainment machine interface 40 has elements as described above. These elements communicate with data processor 41. The data processor 41 is further in communication with a memory 43 which stores instructions for the data processor 41, as well as calculations and determinations by the data processor 41. A display 42 provides a visual output of the results, and any other information that the data processor 41 is instructed to output.

Casinos would earn revenue from this game offering by taking a percentage of money wagered before payouts are made to players. The actual value of this percentage would most likely be determined by each individual casino, but I would prescribe taking a 10% cut.

Regardless of the actual percentage, a cut would be taken of all regular pots, as well as another separate cut of the same percentage from the Bonus Pool once it is paid out. The cut of a regular pot would be taken at the completion of a hand before any payouts are made or any money is put into the Bonus Pool. The cut of a Bonus Pool would be taken from a 'locked-in' when it is about to be paid out.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. An entertainment machine comprising:

a data processor;

a display in communication with the data processor;

a user interface in communication with the data processor; and a computer memory, wherein the computer memory is configured to store program instructions executable by the data processor to conduct the steps of:

receiving an input from a player regarding selection of one of a plurality of slots through the user interface;

receiving a bid amount input from the player regarding the selection of the one of the plurality of slots, through the user interface;

receiving an input from a plurality of other players regarding selection of one of the plurality of slots;

receiving a bid amount input from each of the plurality of other players regarding the selection of the one of the plurality of slots;

calculating a total number of selections of each of the plurality of slots;

determining the slot having a fewest but non-zero selections;

distributing a proportional payout of a total bid comprising a sum of all bid amounts to any of the player and the plurality of other players having selected the slot having the fewest but non-zero selections;

wherein at least one of the plurality of players is a computerized player, the computerized player operable to select the one of the plurality of slots using a programmed randomizer;

wherein the data processor is further operable to carry out the steps of:

checking a quantity of slot selections made by the programmed randomizer over a first predetermined time period;

comparing the quantity of selections to an expected random slot selection over the first predetermined time period;

causing the programmed randomizer to overweight a selection of one of the plurality of slots by the programmed randomizer over a second predetermined time period when the expected random slot selection is not equal to the quantity of slot selections in the first predetermined time period; and wherein the step of causing the programmed randomizer to overweight the selection of one of the plurality of slots ensures that the expected random slot selection will equal the quantity of slot selections over the second predetermined time period.

2. The entertainment machine of claim 1 wherein the plurality of users are in a networked connection with the data processor.

3. The entertainment machine of claim 1 wherein the plurality of users are in connection with the data processor via a plurality of user interfaces.

4. The entertainment machine of claim 1 further comprising a dealer operable to gather slot selections and bids, the dealer being a computerized dealer.

5. The entertainment machine of claim 1 wherein at least one of the plurality of players is a computerized player, the computerized player operable to select the one of the plurality of slots using a programmed randomizer having a bias towards one of the plurality of slots.

6. The entertainment machine of claim 5 wherein the data processor is operable to carry out the step of checking a quantity of selections made by the computerized player over a predetermined time period, and comparing these selections to an expected biased selection of the plurality of slots such that one of the plurality of slots selections is selected more frequently than the other of the plurality of slots.

7. The entertainment machine of claim 1 wherein the computer memory is further configured to store program instructions executable by the data processor to conduct the steps of:

entering a dealer round, the dealer round comprising the steps of:

selecting one of the plurality of slots by a computerized dealer operable by the data processor to randomly or non-randomly pick the one of the plurality of slots;

receiving a dealer round input from the player regarding selection of one of the plurality of slots through the user interface;

receiving a dealer round bid amount input from the player regarding the selection of the one of the plurality of slots, through the user interface;

receiving a dealer round input from a plurality of other players regarding selection of one of the plurality of slots;

receiving a dealer round bid amount input from each of the plurality of other players regarding the selection of the one of the plurality of slots; and distributing a proportional payout of a total bid comprising a sum of the dealer round bid amounts to any user having selected the same slot as selected by the dealer.

8. The entertainment machine of claim 1 wherein the machine comprises a digital card reader in communication with the data processor, the digital card reader operable to receive a payment from a payment card corresponding to a chip value, and operable to provide a payout to the payment card corresponding to a second chip value.

9. The entertainment machine of claim 1 further comprising a printer, the printer operable to print a ticket redeemable for a cash value corresponding to a chip value.

10. The entertainment machine of claim 1 wherein the user interface is operable to display a slot selection history.

11. The entertainment machine of claim 1 wherein the user interface is operable to display a slot selection history of any one of the plurality of other players to the player.

12. The entertainment machine of claim 1 wherein the user interface is operable to display a history of the winning slot for each round of game play.

13. The entertainment machine of claim 1 wherein the data processor is operable to carry out the step of receiving an insurance bid comprising an input from the player to purchase insurance using at least one insurance chip.

14. The entertainment machine of claim 13 wherein the data processor is operable to carry out the step of putting the at least one insurance chip in a bonus pool in a round comprising a minority position.

15. The entertainment machine of claim 14 wherein the data processor is operable to carry out the step of distributing the bonus pool to the player who purchased a most amount of the insurance in a different round that does not comprise the minority position.

16. The entertainment machine of claim 15 wherein the data processor is operable to carry out the step of distributing to the player a proportional payout to the insurance bid.

17. An entertainment machine comprising:

a data processor;

a display in communication with the data processor;

a user interface in communication with the data processor; and a computer memory, wherein the computer memory is configured to store program instructions executable by the data processor to conduct the steps of:

receiving an input from a player regarding selection of one of a plurality of slots through the user interface;

receiving a bid amount input from the player regarding the selection of the one of the plurality of slots, through the user interface;

receiving an input from a plurality of other players regarding selection of one of the plurality of slots;

receiving a bid amount input from each of the plurality of other players regarding the selection of the one of the plurality of slots;

calculating a total number of selections of each of the plurality of slots;

determining the slot having a fewest but non-zero selections; and distributing a proportional payout of a total bid comprising a sum of all bid amounts to any of the player and the plurality of other players having selected the slot having the fewest but non-zero selections; wherein the computer memory is further configured to store program instructions executable by the data processor to conduct the steps of:

entering a dealer round, the dealer round comprising the steps of:

selecting one of the plurality of slots by a computerized dealer operable by the data processor to randomly or non-randomly pick the one of the plurality of slots;

receiving a dealer round input from the player regarding selection of one of the plurality of slots through the user interface;

receiving a dealer round input from a plurality of other players regarding selection of one of the plurality of slots;

distributing a proportional payout of a total bid comprising a sum of the dealer round bid amounts to any user having selected the same slot as selected by the dealer wherein the computerized dealer is operable to select the one of the plurality of slots using a programmed randomizer;

wherein the data processor is further operable to carry out the steps of:

checking a quantity of slot selections made by the programmed randomizer over a first predetermined time period;

comparing the quantity of selections to an expected random slot selection over the first predetermined time period;

causing the programmed randomizer to overweight a selection of one of the plurality of slots by the programmed randomizer over a second predetermined time period when the expected random slot selection is not equal to the quantity of slot selections in the first predetermined time period; and wherein the step of causing the programmed randomizer to overweight the selection of one of the plurality of slots ensures that the expected random slot selection will equal the quantity of slot selections over the second predetermined time period.

18. The entertainment machine of claim 17 wherein the user interface is operable to display a history of prior dealer slot selections.

19. The entertainment machine of claim 17 wherein the computerized dealer is operable to select the one of the plurality of slots using a programmed randomizer having a bias towards one of the plurality of slots.

20. The entertainment machine of claim 19 wherein the data processor is operable to carry out the step of checking a quantity of selections made by the computerized dealer over a predetermined time period, and comparing these selections to an expected biased selection of the plurality of slots such that one of the plurality of slots selections is selected more frequently than the other of the plurality of slots.

* * * * *